US006419380B2

(12) United States Patent
Oyama et al.

(10) Patent No.: US 6,419,380 B2
(45) Date of Patent: Jul. 16, 2002

(54) VEHICLE LIGHT

(75) Inventors: Hiroo Oyama, Sagamihara; Go Adachi, Tokyo; Yoshifumi Kawaguchi; Takashi Akutagawa, both of Kawasaki, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/821,741

(22) Filed: Mar. 30, 2001

(30) Foreign Application Priority Data

Mar. 31, 2000 (JP) ..... 2000-097018

(51) Int. Cl.[7] ..... F21V 7/00
(52) U.S. Cl. ..... 362/517; 362/297; 362/346
(58) Field of Search ..... 362/517, 297, 362/346

(56) References Cited

U.S. PATENT DOCUMENTS 4,858,090 A * 8/1989 Downs ..... 359/858
4,953,063 A * 8/1990 Nino ..... 362/305
5,636,917 A * 6/1997 Furami et al. ..... 362/297
2001/0026457 A1 * 10/2001 Oyama et al. ..... 362/517

FOREIGN PATENT DOCUMENTS

JP 2000-76907 3/2000
JP 2000-182411 6/2000
JP 02001229715 A * 8/2001 ..... F21S/8/10
JP 02001236808 A * 8/2001 ..... F21S/8/10

* cited by examiner

*Primary Examiner*—Thomas M. Sember
*Assistant Examiner*—David V. Hobden
(74) *Attorney, Agent, or Firm*—Morgan, Lewis & Bockius LLP

(57) ABSTRACT

A vehicle light can include a light source, at least one first elliptic group reflecting surface shaped as half of an elliptical surface (after either an upper or lower substantial half of the substantial ellipse is cut-off). The first elliptic group reflecting surface can have its longitudinal axis on an optical axis of the vehicle light, and a first focus located in the vicinity of the light source. Two second elliptic group reflecting surfaces can be provided that are shaped as substantial halves of elliptical surfaces (after either upper or lower substantial halves of substantial ellipses are cut-off). The second elliptic group reflecting surfaces can have longitudinal axes that are substantially perpendicular to the optical axis of the vehicle light, and their first foci can be located in the vicinity of the light source. Two third parabolic group reflecting surfaces can each have its optical axis oriented in a direction that is substantially the same as the direction of the optical axis of the vehicle lamp, and can have foci located in the vicinity of the second focus of each of the second elliptic group reflecting surfaces.

20 Claims, 4 Drawing Sheets

VEHICLE LIGHT

This invention claims the benefit of Japanese Patent Application No. HEI 2000-097018, filed on Mar. 31, 2000, which is hereby incorporated by reference.

BACKGROUND OF THE INVENTION

1. Field of the Invention

The present invention relates to a vehicle lamp for use in the illumination of a headlamp, fog lamp etc., and more particularly relates to a vehicle lamp that forms a light distribution characteristic in a multi-reflex manner using an ellipse group reflector and a parabolic group reflector.

2. Description of the Related Art

FIG. 8 shows a conventional vehicle headlight 90 that includes a parabolic group reflecting surface 91, such as a rotated parabolic surface. FIG. 9 shows another conventional vehicle headlight 80 that includes an elliptic group reflecting surface 81, such as a rotated elliptic surface.

The conventional vehicle headlight 90 includes a parabolic group reflecting surface 91, such as a rotated parabolic surface, having a focus f and rotation axis of an optical axis X, i.e., an illumination direction of the conventional headlight 90. The headlight 90 also includes a light source 92, such as a filament, located in a front vicinity of and at a predetermined distance from the focus f of the parabolic group reflecting surface 91. A shade 92*a* is included for forming low-beam light distribution patterns. Due to the positioning of the light source 92, light reflected by an upper half of the reflecting surface 91 is directed downward. The shade 92*a* covers a lower half of the light source 92 to prohibit certain light rays from being directed towards a lower half of the parabolic group reflecting surface 91. The certain light rays would be upwardly directed light rays after being reflected by the lower half of the parabolic group reflecting surface 91.

The conventional vehicle headlight 80 includes an elliptic group reflecting surface 81, such as a rotated elliptic surface, having a first focus f1 and a second focus f2, a light source 82 located on the first focus f1, a shading plate 83 located in the vicinity of the second focus f2, and a projection lens 84 having its focus in the vicinity of the second focus f2. Light reflected by the elliptic group reflecting surface 81 converges to the second focus f2. An image of luminous flux at the second focus f2 is projected upside-down in the illumination direction X by the projection lens 84. When the headlight 80 is placed into low-beam mode, the shading plate 83 prohibits a portion of luminous flux from converging at the second focus f2 such that a predetermined shape of a low-beam light distribution pattern for the vehicle headlight 80 is provided.

Conventional vehicle headlights 90 and 80 have the following problems. First, the conventional vehicle headlights 90 and 80 have little design flexibility. In the conventional vehicle headlights 90 and 80, light emitted at all directions from the light source 92 or 82 is reflected into illumination direction X of the headlight 90 or 80 by the parabolic group reflecting surface 91 or the elliptic group reflecting surface 81 to determine the light distribution patterns of the headlights 90 or 80. Accordingly, either the length or width (as viewed from the front of headlights 80 or 90) must be larger than 70 mm to provide a sufficient amount of light. If either of the length or width dimensions is equal to or smaller than 70 mm, the utilization efficiency of luminous flux emitted from light source by the reflecting surfaces 91 or 81 greatly decreases, and it is substantially impossible to function as a headlight. In addition, the conventional vehicle headlights 90 and 80 include a shade 92*a* and a shading plate 83, respectively. The shade 92*a* and the shading plate 83 prohibit substantially half of the total light amount from the light sources 92 and 82. Therefore, it has been a goal with conventional lights to improve utilization efficiency of lumen output in the low-beam light distribution pattern. The low-beam light distribution is usually employed at night-time while the traveling light distribution (high-beam mode) is usually employed during the day, during a drive on the highway, or in desolate areas.

SUMMARY OF THE INVENTION

In order to resolve the aforementioned and other problems in the related art, the present invention provides a vehicle light that can include a light source, and at least one first elliptic group reflecting surface that is shaped as a substantial half of an elliptic surface, i.e., the portion that remains after either an upper or lower substantial half of the ellipse is removed. The reflector can have a longitudinal axis on an optical axis of the vehicle light and a first focus in vicinity of the light source. Two second elliptic group reflecting surfaces can be provided and shaped as substantial halves of elliptic surfaces, i.e., the portions that remain after either upper or lower substantial halves of the ellipses are cut-off (both of which substantially correspond to the shape of the first elliptic group reflecting surface). The second elliptic group reflecting surfaces can have longitudinal axes that are substantially horizontally perpendicular to the optical axis of the vehicle light and first foci located in the vicinity of the light source. The vehicle light can also include two third parabolic group reflecting surfaces, each having its optical axis in a direction parallel to the optical axis of the vehicle lamp and its focus in the vicinity of a second focus of each second elliptic group reflecting surface.

DETAILED DESCRIPTION OF THE PREFERRED EMBODIMENTS

Figure 1:
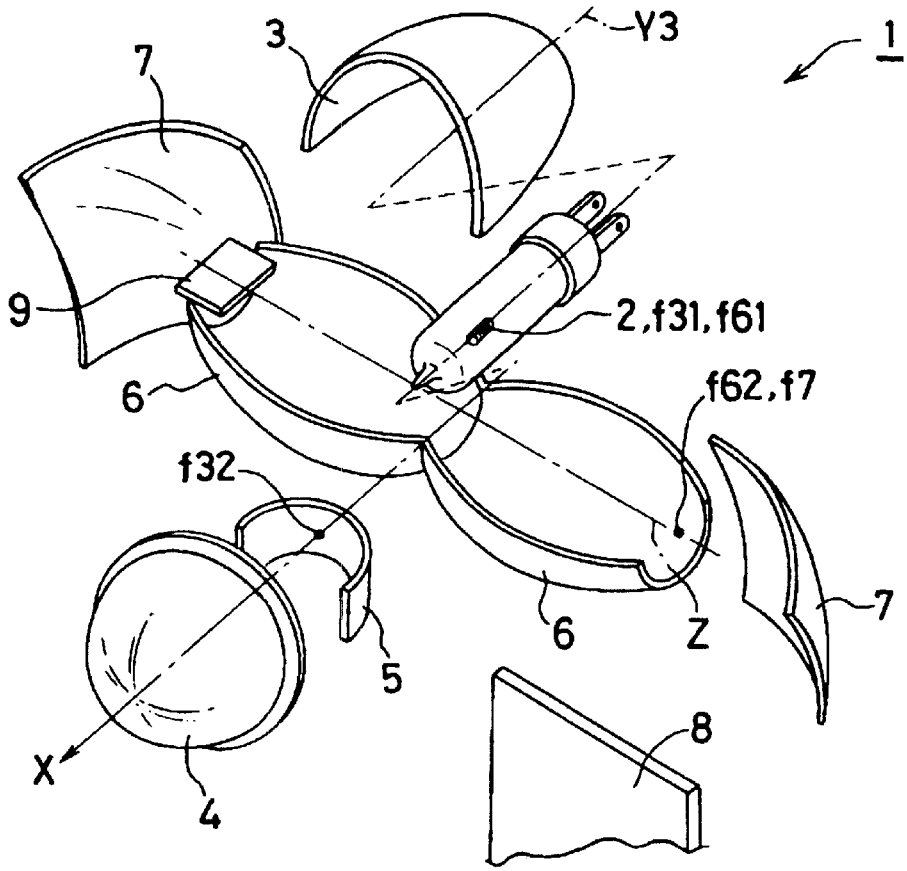
FIG. 1 is an exploded view of a vehicle lamp according to a preferred embodiment of the present invention.

Detailed description of the present invention will now be given based on embodiments shown in the drawings. FIG. 1 shows a vehicle light 1 having a multi-reflex system according to a preferred embodiment of the invention. The vehicle light 1 can include a light source 2, a first reflecting surface 3 shaped substantially as a remaining half of an elliptical surface (after a lower substantial half of the substantial elliptical surface is cut off along its longitudinal axis), a projection lens 4 and a shade 5, such that a low-beam mode light distribution pattern can be formed.

The first reflecting surface 3 can be an elliptic group reflecting surface, such as a rotated elliptic surface, having its first focus f31 in the vicinity of the light source 2 and having its longitudinal axis Y3 oriented in a direction of an optical axis of X of the vehicle light 1. A second focus f32 of the first elliptic group reflecting surface 3 can be located on the optical axis X in front of the first focus f31. In general, the ellipse group reflecting surface can include a curved surface having an ellipse or similar shape, such as a rotated elliptic surface, a complex elliptic surface, an elliptical free-curved surface, or combination thereof. The shade 5 can be located in the vicinity of the second focus f32 to prohibit certain light rays from being directed towards the front and upward among the light rays that converge at the second focus f32 as viewed in cross-section.

A cross-sectional image of the luminous flux as adjusted by the shade 5 is projected by projection lens 4 in an illumination direction parallel to the optical axis X of the vehicle light 1. Thus, a specific light distribution pattern for the vehicle light 1 can be provided. The shade 5 may include a portion that forms a so-called "elbow" in the light distribution pattern. The "elbow" is a portion of the low-beam mode light distribution pattern in which a cut-off line is inclined upwards at about 15 degrees on the left side relative to a horizontal axis of the light distribution pattern for driving in the left lane, such as when driving in England and Japan. This light distribution pattern allows the driver to better see pedestrians and other objects on the curb side of the road. Of course, the "elbow" light distribution pattern can angle upwards on the right side for vehicles that are normally driven in the right lane.

The first elliptic group reflecting surface 3 is able to provide substantially the same light amount as conventional vehicle headlights 90 and 80, despite the lower substantial half of the substantial ellipse surface being cut-off with regard to the first elliptic group reflecting surface 3.

The vehicle light 1 can also include a pair of second reflecting surfaces 6 located at a position corresponding to where the cut substantial half of the substantial ellipse surface of the first elliptic group reflecting surface 3 would be located. Each second reflecting surface 6 can be an elliptic group reflecting surface, and each longitudinal axis Z of each second reflecting surface 6 can be approximately perpendicular to the optical axis X of the vehicle light 1. In other words, the pair of second elliptic group reflecting surfaces 6 can be located at left and right sides of the light source 2, and each first focus f61 of the second elliptic group reflecting surfaces 6 can be substantially located at the light source 2.

Each second focus f62 of the second elliptic group reflecting surfaces 6 can be located around an external end of each elliptic group second reflecting surface 6 along its longitudinal axis Z, i.e., located at an end opposite to the light source 2. A pair of third parabolic group reflecting surfaces 7, such as rotated parabolic surfaces having their respective foci f7 and their respective optical axes parallel to the optical axis X of the vehicle light 1, can be located around respective outer ends of the second elliptic group reflecting surfaces 6. Each focus f7 of the third parabolic group reflecting surfaces 7 can be located in the vicinity of each second focus f62 of the elliptic group second reflecting surfaces 6. The term parabolic group reflecting surface can be defined as a curved surface having a parabola or similar shape as a whole, such as a rotated parabolic surface, a complex parabolic surface, paraboloidal surface, a parabolic free-curved surface, or combination thereof.

Light emitted downward from the light source 2 is reflected by the second elliptic group reflecting surfaces 6, and transmitted in a left and right direction in a multi-reflex manner to converge to the respective second foci f62. The second focus f62 functions as a light source of each third parabolic group reflecting surface 7. The third parabolic group reflecting surfaces 7 reflect light rays such that they travel parallel to the optical axis X of the vehicle light 1. A front lens 8 may have prismatic cuts (not shown) such that light rays passing through the front lens 8 are diffused into predetermined directions, such as left or right, with predetermined illumination angles.

FIGS. 2–7 illustrate light distribution pattern adjusting devices and light pattern distributions when light distribution of the vehicle light 1 is formed by the second elliptic group reflecting surfaces 6 and the third parabolic group reflecting surface 7. According to experimental results and testing by the inventors, it is beneficial to have a light guide tube 9 in the vicinity of the second focus f62 of the second elliptic group reflecting surface 6 for forming, adjusting, and changing the mode of, light distribution patterns of the vehicle light 1.

Figure 2:
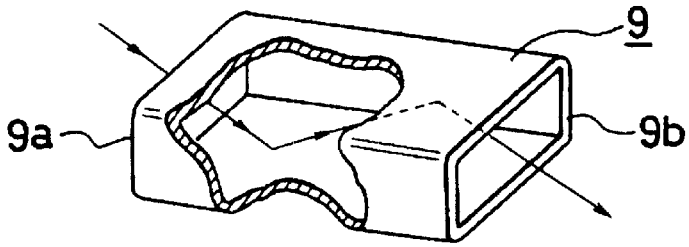
FIG. 2 is a partially broken view of the first light guide tube as shown in FIG. 1.

FIG. 2 illustrates the light guide tube 9 according to a preferred embodiment of the present invention. The light guide tube 9 can be formed as a pipe. In this embodiment, the light guide tube 9 appears rectangular in cross-section. Inner surfaces of the light guide tube 9 can be mirror surfaces. The second focus f62 of the second elliptic group reflecting surface 6 is preferably located around an aperture end 9*a* of the light guide tube 9. The focus f7 of the third parabolic group reflecting surface 7 is preferably located around the other aperture end 9*b* of the light guide tube 9.

Light reflected by the second elliptic group reflecting surface 6 enters into the light guide tube 9 through the aperture end 9*a*. Light rays can be reflected within the light guide tube 9 in a multi-reflex manner, and transmitted to the other aperture end 9*b*. The light rays are radiated from the other aperture end 9*b* toward the third parabolic group reflecting surface 7. The light guide tube 9 can have the following functions. First, the light guide tube 9 determines the image or shape of luminous flux that is to be provided as a light source for the third parabolic group reflecting surface 7 by the cross-sectional shape of the other aperture end 9*b*.

Second, the light guide tube 9 transmits light rays within the light guide tube 9 without any significant loss of light amount. Additionally, cross-sectional images of luminous flux are the same between those at the aperture end 9*a*, i.e. an entry to the light guide tube 9, as at the other aperture end 9*b*, i.e. an exit from the light guide tube 9. Therefore, the third parabolic group reflecting surface 7 can be more flexibly positioned relative to the second elliptic group reflecting surface 6 by changing the length of the light guide tube 9 or the direction of apertures of the light guide tube 9.

Figure 3:
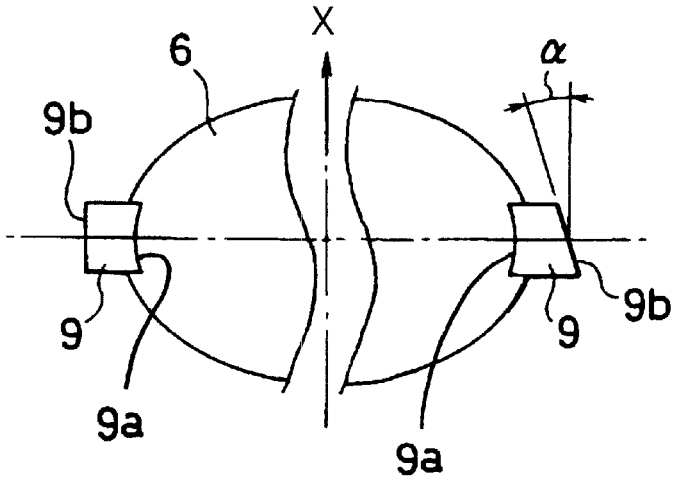
FIG. 3 is a partial horizontal cross-section of a second light guide tube according to another preferred embodiment of the invention.

FIG. 3 schematically illustrates an example of the light guide tube 9 according to another preferred embodiment of the present invention. In this embodiment, a vehicle light can include two light guide tubes 9, each located in the vicinity of each second focus f62 of the two second elliptic group reflecting surfaces 6 that are connected around the respective first foci f61. One aperture end 9*a* of each light guide tube 9 on the side of the light source 2 may be curved inwardly to collect larger amount of light when the light guide tube 9 is moved during mode change (i.e., from high-beam to low-beam or vice versa) of light distribution pattern of the vehicle light 1.

Figure 4:
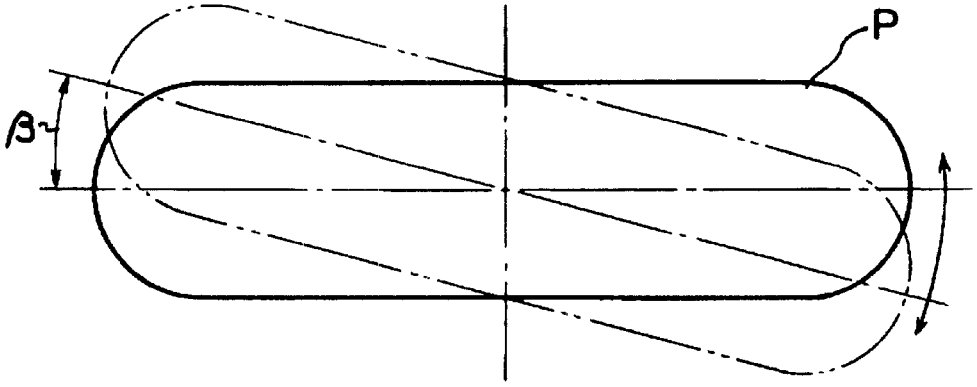
FIG. 4 is a varying light distribution pattern from the third parabolic reflecting surface formed by the varying shape of an aperture end of the second light guide tube of FIG. 3.

FIG. 4 illustrates light distribution patterns P from the third parabolic group reflecting surface 7 which has the aperture end 9*b* acting as its light source. Each light distribution pattern P is a projected image of the light source. In the preferred embodiment shown in FIG. 2, the aperture end 9*b* facing towards the third parabolic group reflecting surface 7 is parallel to the optical axis X of the vehicle light 1. On the other hand, an angle β of inclination of the horizontal axis of the light distribution pattern P relative to a horizontal axis on formation of light distribution patterns varies depending on an angle α between the aperture end 9*b* and a parallel line to the optical axis X, as shown in the embodiment of FIG. 3.

Figure 5:
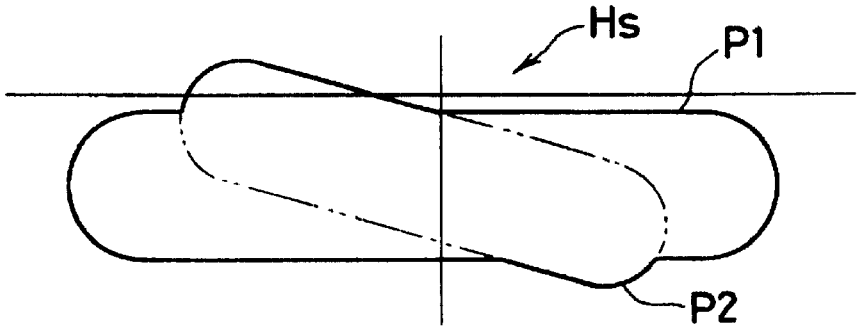
FIG. 5 is a light distribution pattern of the vehicle lamp formed by light guide tubes that have optimized shapes at their respective aperture ends according to the embodiment of FIG. 3.

FIG. 5 illustrates a light distribution pattern Hs obtained by the embodiment of FIG. 3. A light distribution pattern element P1 is obtained by setting the angle α of the other end 9*b* of one of the two light guide tubes 9 such that light distribution pattern element P1 has a horizontal axis parallel to the horizontal axis on formation of light distribution pattern. For example, the other end 9*b* of one of the two light guide tube 9 can be parallel to the optical axis X of the vehicle light 1. The light distribution pattern element 2 is obtained by adjusting the angle α of the other end 9*b* of the other one of the two light guide tubes 9 such that the light distribution pattern element P2 has its horizontal axis inclined at angle β relative to the horizontal axis on formation of light distribution pattern. If the light distribution pattern element P2 is inclined left side up relative to the horizontal axis of an angle β of 15 degrees, the light distribution pattern Hs is appropriate for a low-beam mode light distribution pattern for driving in the left lane, and provides substantially the same light distribution pattern as obtained by the first reflecting surface 3 and the shade 5 in the embodiment of FIG. 1.

Figure 6:
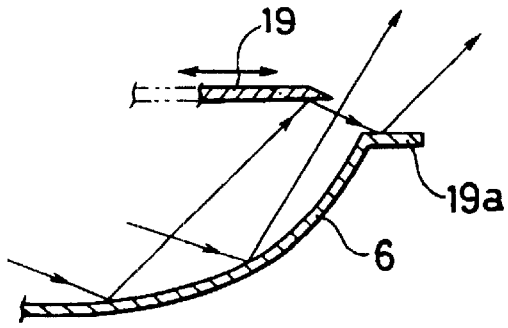
FIG. 6 is a cross-sectional view of an alternative to the light guide tube, according to another preferred embodiment of the invention.

FIG. 6 illustrates a part of another preferred embodiment of the present invention. In this embodiment, a movable shading plate 19 can be used instead of the light guide tube 9. A major function of the light guide tube 9 can be to determine an image of luminous flux at the second focus f62 of the second elliptic group reflecting surface i.e., to provide a light source for the third parabolic group reflecting surface 7. The design of the movable shading plate 19 is based on, and an improvement over, the principles used in making shading plate 82 as shown in the conventional projection-type vehicle headlight 80. A portion of the light rays traveling from the second elliptic group reflecting surface 6 towards the third parabolic group reflecting surface 7 can be prohibited from impinging on the second focus f62 of the second elliptic group reflecting surface 6 by the movable shading plate 19. The movable shading plate 19 can be movable between a low-beam mode position and a high-beam mode position. In order to reduce a loss of the light amount shaded by the shading plate 19, the shading plate 19 can include a mirror surface facing the second elliptic group reflecting surface 6. Furthermore, a complementary plate 19*a* can be arranged to reflect light rays from the mirror surface of the shading plate 19 toward the third parabolic group reflecting surface 7. The combination of the shading plate 19 and the complementary plate 19*a* is quite effective in reducing the loss of light that is usable for light distribution from the vehicle light 1 when the shading plate 19 is adopted. Although not illustrated, a similar structure to the shading plate 19 and the complementary plate 19*a* may be used with the shade 5 and the first elliptic group reflecting surface 3. In this case, the shading plate 19 has a mirror surface facing the light source 2, and the complementary plate 19*a* can be arranged to reflect light rays from the mirror surface of the shading plate 19 toward either one of the first elliptic group reflecting surface 3, the second elliptic group reflecting surface 6 and the third parabolic group reflecting surface 7.

Figure 7:
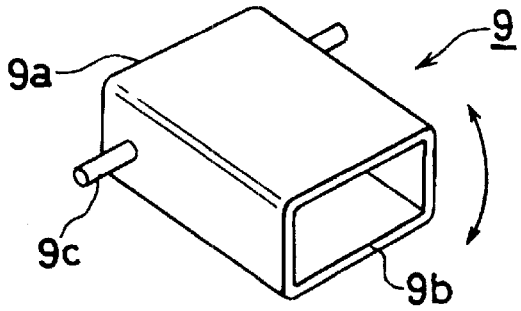
FIG. 7 is a perspective view of a light guide tube according to another preferred embodiment of the invention.
Figure 8:
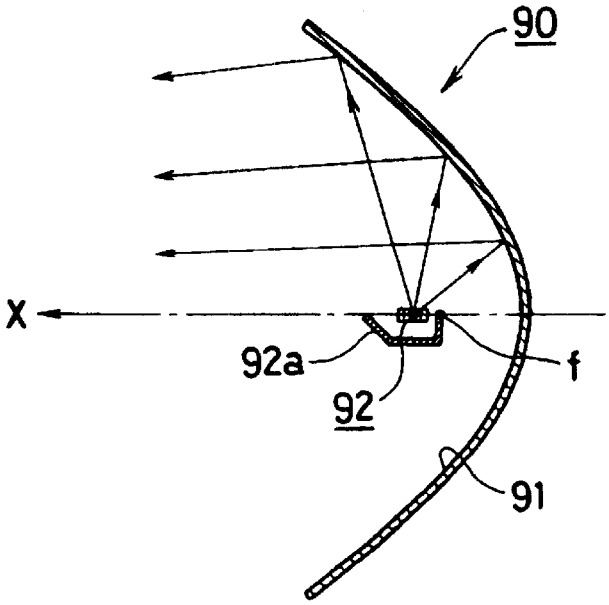
FIG.8 CONVENTIONAL ART
FIG. 8 is a cross-sectional view of a conventional vehicle headlight.
Figure 9:
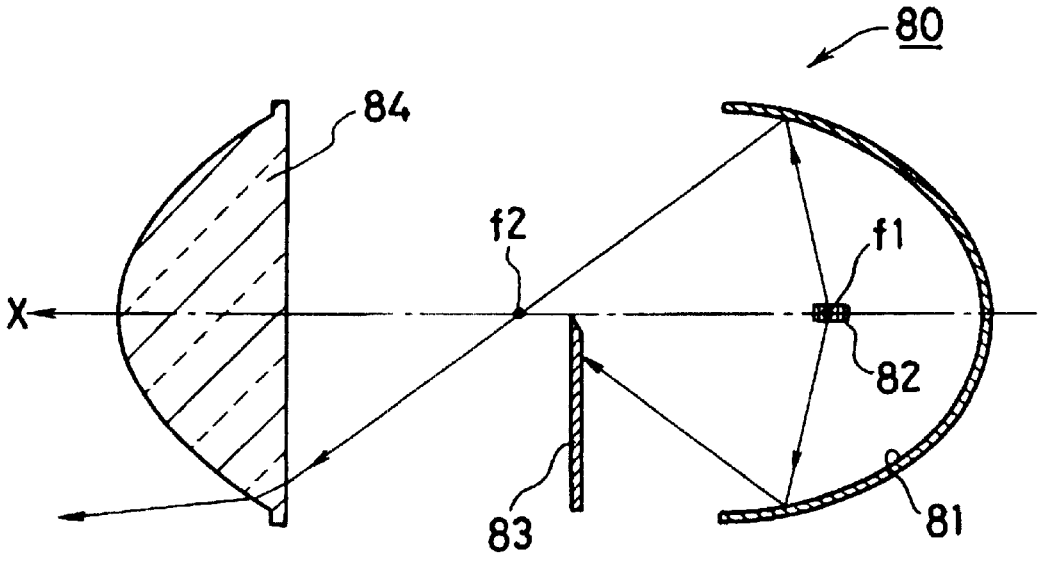
FIG.9 CONVENTIONAL ART
FIG. 9 is a cross-sectional view of another conventional vehicle headlight.

Next, the configuration and method for changing the mode of light distribution pattern for the lamp will now be described. Regarding the first elliptic group reflecting surface 3, the shade 5 can be arranged to shade upwardly directed light rays at the second focus f32 of the first elliptic group reflecting surface 3 to form a low-beam mode light distribution pattern. When changing the light distribution pattern from low-beam mode to high beam mode, the high-beam mode light distribution pattern can be obtained by moving the shade 5 away from luminous flux that converges at the second focus f32 of the first elliptic group reflecting surface 3. When the shade 5 is moved to its high-beam mode position, it can achieve sufficient high-beam mode light distribution characteristics for the vehicle light 1 without requiring movement of any other element with shade 5. However, the light guide tube 9 may be moved to its high-beam position with the shade 5. FIG. 7 illustrates a movable light guide tube 9 according to another embodiment of the present invention. The movable light guide tube 9 can include a rotational axis 9*c* that is pivoted on the side of the second elliptic group reflecting surface 6. The aperture end 9*a* on the side of the second elliptic group reflecting surface 6 can serve as a center of rotation. If the light guide tube 9 is rotationally moved about the rotational axis 9*c*, and the other aperture end 9*b* on the side of the third parabolic group reflecting surface 7 is moved in an up and down direction relative to the focus f7 of the third parabolic group reflecting surface 7, the direction of light reflected by the third parabolic group reflecting surface 7 can be changed from a downward direction to an upward direction, or vice versa. For example, if the movable light guide tube 9 is rotated downward from its low-beam mode position, the light distribution mode is changed from low-beam mode to high-beam mode with regard to the light reflected by the third parabolic group reflecting surface 7.

When shading plate 19 is used instead of the light guide tube 9, the light distribution mode can be changed from low-beam mode to high-beam mode by moving the shading plate 19 away from the luminous flux that converges at the focus f62 of the second elliptic group reflecting surface 6. This action is similar to when the shade 5 is moved away from luminous flux that converges at the second focus f32 of the first elliptic group reflecting surface 3.

The operational advantages of the present invention will now be described. First, utilization efficiency of light emitted from the light source 2 for low-beam mode light distribution of the vehicle light 1 is greatly improved and can be substantially twice that of conventional vehicle headlamps 90 and 80 which have a parabolic group reflecting surface 91 and an elliptic group reflecting surface 81, respectively. In the conventional vehicle headlamps 90 and 80, almost all light emitted from the light source 92 or 82 directed towards a lower half of the parabolic group reflecting surface 91 or the elliptic group reflecting surface 81 is not used for formation of light distribution patterns of the headlamps 90 and 80, because such light is prohibited by the shade 92*a* or the shading plate 83. In the vehicle lamp 1 of the present invention, a majority of light emitted from the light source 2 that is directed downward is reflected by the second elliptic group reflecting surface 6 toward the third parabolic group reflecting surface 7. The third parabolic group reflecting surface 7 reflects light from the second elliptic group reflecting surface 6 such that it travels parallel to the optical axis X of the vehicle light 1.

The vehicle light of the present invention also has a large aspect ratio with a larger width as viewed from the front of the lamp, which provides favorable design characteristics for use in, for example, an automobile headlight. A vehicle light having a large width and a small length satisfies recent design trends. In the vehicle light 1, a third parabolic group reflecting surface 7 is located respectively on left and right sides of the first elliptic group reflecting surface 3. The first elliptic group reflecting surface 3 and the two third parabolic reflecting surfaces 7 can be positioned substantially in a horizontal direction.

Various modifications of the vehicle light 1 are possible. In the vehicle light 1, the lower substantial half of the substantial ellipse can be cut-off in the first elliptic group reflecting surface 3. The second elliptic group reflecting surfaces 6 can be arranged at a location corresponding to the cut-off portion of the substantial ellipse of the first elliptic group reflecting surface 3. However, it is possible that the upper substantial half of the substantial ellipse of the first elliptic group reflecting surface 3 is cut-off, and the second elliptic group reflecting surface 6 is arranged on an upper end of the first elliptic group reflecting surface 3 corresponding to the upper cut-off portion. In another example, the first elliptic group reflecting surface 3 may not be limited to one single smooth reflecting surface, but may include a plurality of reflecting surface elements connected to each other. For example, two reflecting surface elements having different radii of curvature may be arranged continuously in a vertical direction.

It will be apparent to those skilled in the art that various changes and modifications can be made herein without departing from the spirit and scope of the invention. Thus, it is intended that the present invention covers the modifications and variations of the invention provided they come within the scope of the appended claims and their equivalents.

What is claimed is:

1. A vehicle light having an optical axis and a multi-reflex optical system, comprising:

a light source;

at least one first elliptic group reflecting surface shaped as an approximate half of an elliptical surface, and having a longitudinal axis oriented in substantially the same direction as the optical axis of the vehicle light, a first focus located in the vicinity of the light source and a second focus located substantially along the longitudinal axis;

two second elliptic group reflecting surfaces shaped as approximate halves of elliptical surfaces, each of the second elliptic group reflecting surfaces having a longitudinal axis that is approximately orthogonal to the optical axis of the vehicle light, a first focus located in the vicinity of the light source and a second focus located substantially along the longitudinal axis; and two third parabolic group reflecting surfaces, each having a focus located in the vicinity of a respective one of the second foci of the two second elliptic group reflecting surfaces, and an optical axis that is substantially parallel to the optical axis of the vehicle light.

2. A vehicle light according to claim 1, wherein a shade is located n the vicinity of the second focus of the at least one first elliptic group reflecting surface.

3. A vehicle light according to claim 2, wherein the shade is connected to a shade position adjusting device for changing a mode of light distribution pattern for the vehicle light.

4. The vehicle light according to claim 1, wherein at least one light guide tube is located in the vicinity of one of the two second foci of the second elliptic group reflecting surfaces.

5. The vehicle light according to claim 2, wherein at least one light guide tube is located in the vicinity of one of the two second foci of the second elliptic group reflecting surfaces.

6. The vehicle light according to claim 3, wherein at least one light guide tube is located in the vicinity of one of the two second foci of the second elliptic group reflecting surfaces.

7. The vehicle light according to claim 1, wherein at least one light guide plate is located in the vicinity of one of the second foci of the second elliptic group reflecting surfaces.

8. The vehicle light according to claim 2, wherein at least one light guide plate is located in the vicinity of one of the second foci of the second elliptic group reflecting surfaces.

9. The vehicle light according to claim 3, wherein at least one light guide plate is located in the vicinity of one of the second foci of the second elliptic group reflecting surfaces.

10. The vehicle light according to claim 4, wherein the light guide tube has first and second aperture ends, the first aperture end being located adjacent one of the third parabolic group reflecting surfaces and having a different shape from that of the second aperture end, the different shape providing predetermined light distribution characteristics to be emitted from the one of the third parabolic group reflecting surfaces.

11. The vehicle light according to claim 5, wherein the light guide tube has first and second aperture ends, the first aperture end being located adjacent one of the third parabolic group reflecting surfaces and having a different shape from that of the second aperture end, the different shape providing predetermined light distribution characteristics to be emitted from the one of the third parabolic group reflecting surfaces.

12. The vehicle light according to claim 6, wherein the light guide tube has first and second aperture ends, the first aperture end being located adjacent one of the third parabolic group reflecting surfaces and having a different shape from that of the second aperture end, the different shape providing predetermined light distribution characteristics to be emitted from the one of the third parabolic group reflecting surfaces.

13. The vehicle light according to claim 4, wherein the at least one light guide tube is connected to a light guide tube adjusting device for changing a mode of light distribution pattern for the vehicle light.

14. The vehicle light according to claim 5, wherein the at least one light guide tube is connected to a light guide tube adjusting device for changing a mode of light distribution pattern for the vehicle light.

15. The vehicle light according to claim 6, wherein the at least one light guide tube is connected to a light guide tube adjusting device for changing a mode of light distribution pattern for the vehicle light.

16. The vehicle light according to claim 7, wherein the at least one light guide plate is connected to a light guide plate adjusting device for changing a mode of light distribution pattern for the vehicle light.

17. The vehicle light according to claim 8, wherein the at least one light guide plate is connected to a light guide plate adjusting device for changing a mode of light distribution pattern for the vehicle light.

18. The vehicle light according to claim 9, wherein the at least one light guide plate is connected to a light guide plate adjusting device for changing a mode of light distribution pattern for the vehicle light.

19. A vehicle light having an optical axis, comprising:

a light source;

at least one first elliptic group reflecting surface shaped as an approximate half of an elliptical surface, and having a longitudinal axis oriented in substantially the same direction as the optical axis of the vehicle light, a first focus located in the vicinity of the light source and a second focus located substantially along the longitudinal axis;

means for directing light from the light source in directions substantially perpendicular to the optical axis of the vehicle light and converging at two second foci; and means for directing the light, after being acted on by the means for directing light, such that light is redirected from each of the two second foci towards a direction that is substantially parallel to the optical axis of the vehicle light.

20. The vehicle light of claim 19, wherein the means for directing includes two second elliptic group reflecting surfaces shaped as approximate halves of elliptical surfaces, each of the second elliptic group reflecting surfaces having a longitudinal axis that is approximately orthogonal to the optical axis of the vehicle light, and the means for redirecting includes two third parabolic group reflecting surfaces, each having a focus located in the vicinity of a respective one of the two second foci, and an optical axis that is substantially parallel to the optical axis of the vehicle light.

* * * * *